US006086028A

United States Patent [19]

Pfister

[11] Patent Number: 6,086,028

[45] Date of Patent: Jul. 11, 2000

[54] TABLE LEG WITH CABLE MANAGEMENT SYSTEM

[76] Inventor: Joel W. Pfister, 4967 Kensington Gate, Shorewood, Minn. 55331

[21] Appl. No.: 09/320,309

[22] Filed: May 26, 1999

[51] Int. Cl.[7] ..... A47B 91/00

[52] U.S. Cl. ..... 248/188.8; 108/50.01; 108/50.02; 312/223.3; 312/223.6

[58] Field of Search ..... 108/50.01, 50.02, 108/190; 248/188.8, 188.1, 188, 677; 312/198, 223.6, 223.3; 52/220.2, 220.7

[56] References Cited

U.S. PATENT DOCUMENTS 4,296,981 10/1981 Hildebrandt et al. ..... 312/194
5,237,935 8/1993 Newhouse et al. ..... 312/223.6
5,357,874 10/1994 Palmer ..... 108/50.01
5,715,761 2/1998 Frattini ..... 108/50.02

*Primary Examiner*—Leslie A. Braun
*Assistant Examiner*—Jon A Szumny
*Attorney, Agent, or Firm*—Hugh D. Jaeger

[57] ABSTRACT

A cable management system incorporated for use in routing one or more cables through the readily accessible interior of an open channel structure used for a leg of a table. A positionable access panel is attached by springs to the interior of the open channel structure and is maneuvered to reveal a channel opening and thus allow access to the interior of the open channel structure for cable routing, and is maneuvered once again to close the channel opening and capture the routed cable therein.

6 Claims, 10 Drawing Sheets

TABLE LEG WITH CABLE MANAGEMENT SYSTEM

CROSS REFERENCES TO CO-PENDING APPLICATIONS

None.

BACKGROUND OF THE INVENTION

1. Field of the Invention

The present invention pertains to a cable management system, and more particularly, relates to a cable management system incorporated for use in routing one or more cables through the readily accessible interior of a channel used for a leg of a table.

2. Description of the Prior Art

Prior art devices for containing cables or wires in table legs provided panels which were removable to cable or wire placement or routing. Other devices feature panels which were secured in place such as by nut and bolt hardware subsequent to cable or wire placement or routing. Other devices have been provided for management of cables in table legs, but none have incorporated a spring loaded access panel in conjunction with an opening in a channel-shaped cable carrying table leg device. Yet in other devices, a cable or electric cord was not securely held within the confines of the table leg and could be inadvertently caused to be removed, such as by an individual tripping on the cord.

SUMMARY OF THE INVENTION

The present invention provides a cable management system for use as a table leg. The present invention is a table leg cable management system where a C-shaped open channel structure, a table leg, which includes a channeled interior and a positionable access panel positioned across an opening in the channel, accepts, accommodates and routes one or more cables along the channeled interior of the C-shaped open channel structure. The positionable access panel is held in position across a channel opening and secured by horizontally oriented springs to an interior surface of the C-shaped open channel structure and is easily and readily maneuvered and operated manually and without the use of tools to gain entry to the channeled interior for placement of one or more cables therewithin. Upper and lower access openings are located at the upper and the lower regions of the C-shaped open channel structure in close proximity to the top and bottom edges of the positionable access panel to lead the cable(s) into or out from the channeled interior of the C-shaped open channel structure. Although one or more preferred embodiments envision one positionable access panel flanked by adjacent access openings, the use of more than one positionable access panel, each end of which is flanked by one or more access openings, lies within the teachings of the invention and shall not be construed to be limiting to the scope of the invention. Although the invention relates to a table leg cable management system, the teachings of the invention can also be applied to carriage, distribution and management of one or more cables along the interior of a channeled structure for distribution of cables, wires and the like along walls, ceilings, floors, work benches, computer work stations, electronic assemblies and other areas and in situations where cable management is required.

According to one or more embodiments of the present invention there is provided a C-shaped open channel structure, a table leg, with a cable management system incorporated within. An open C-shaped channel, the leg, extends between a base and an upper mounting plate. A vertically oriented channel opening is located between the vertically aligned edges of the open C-shaped channel. A positionable access panel is held in alignment along and across the vertically oriented channel opening by a plurality of springs mounted between the positionable access panel and the interior of the open C-shaped channel. The positionable access panel is shorter in length than the channel opening in the open C-shaped channel and is located centrally in the channel opening to, in part, form access openings at the upper and lower regions of the open C-shaped channel.

One significant aspect and feature of the present invention is an open C-shaped channel, or table leg, with a cable management system having a minimum of moving parts.

Another significant aspect and feature of the present invention is a table leg with a cable management system having a positionable access panel held in a closed position against a channel opening in a C-shaped open channel structure.

Another significant aspect and feature of the present invention is an open C-shaped channel table leg with a cable management system where a positionable access panel is secured to a C-shaped open channel structure by springs.

Another significant aspect and feature of the present invention is a table leg with a cable management system where a positionable access panel is operated about springs to gain entry to the interior of a C-shaped open channel structure or to close entry to the interior of the C-shaped open channel structure.

Another significant aspect and feature of the present invention is a positionable access panel having lips which assist in alignment of the positionable access panel within the channel opening of a C-shaped open channel structure.

Another significant aspect and feature of the present invention is positive and secure containment of a cable within an open C-shaped channel table leg without the possibility of inadvertent removal.

Having thus described significant aspects and features of one or more embodiments of the present invention it is the primary objective hereof to provide a table leg with a cable management system.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
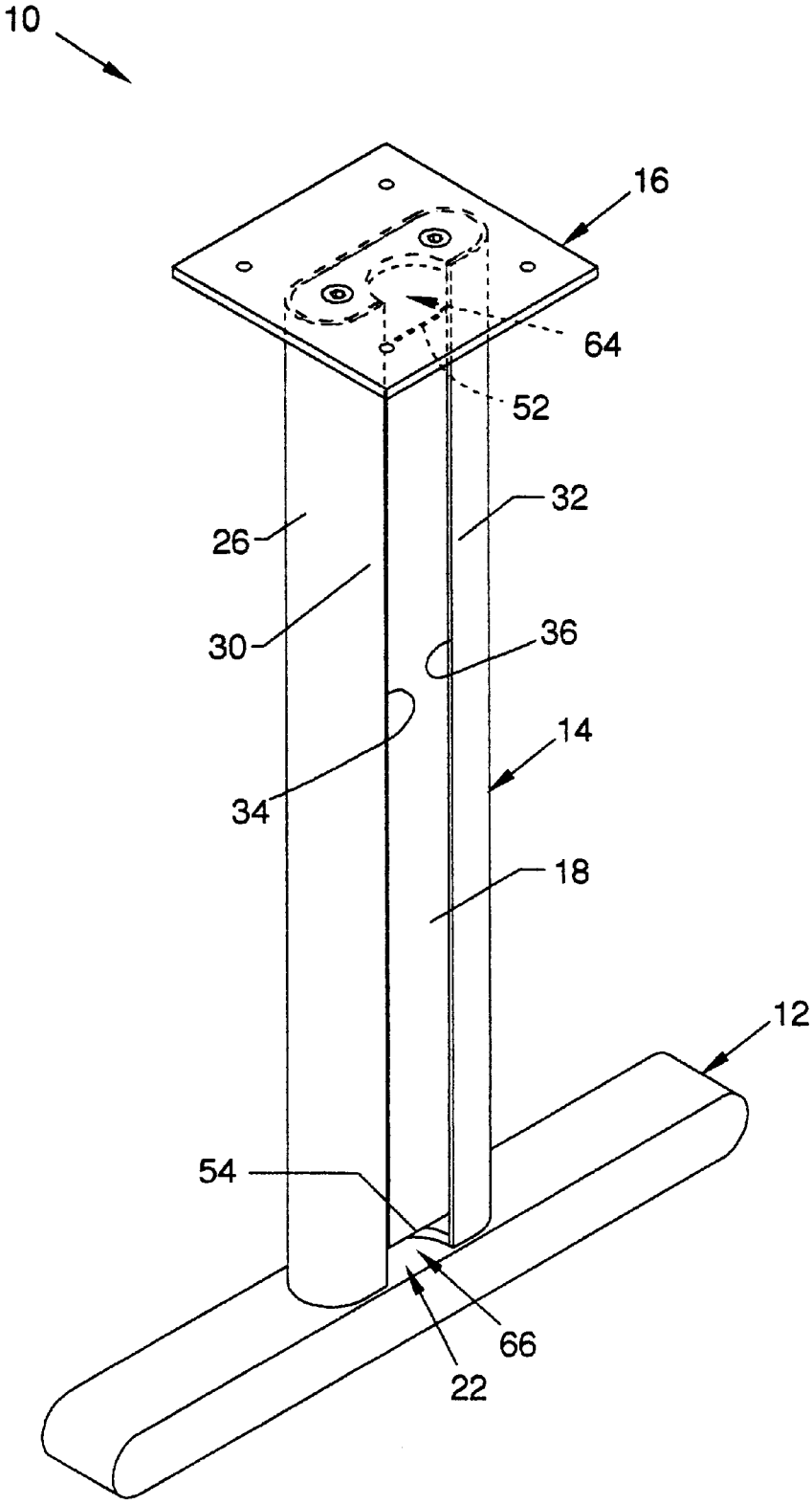
FIG. 1 illustrates an isometric view of a table leg with a cable management system, the present invention.

FIG. 1 illustrates an isometric view of a table leg with a cable management system 10, the present invention. Visible components of the table leg with a cable management system 10 include a base 12, an open C-shaped channel 14 comprising a leg, a mounting plate 16 and a positionable access panel 18. The open C-shaped channel 14 is in the shape of an elongated C-shaped channel extending vertically between the base 12 and the mounting plate 16. The positionable access panel 18, having a shorter vertical dimension than the open C-shaped channel 14, aligns to a channel opening 22 extending vertically along the open C-shaped channel 14, as later described in detail.

Figure 2:
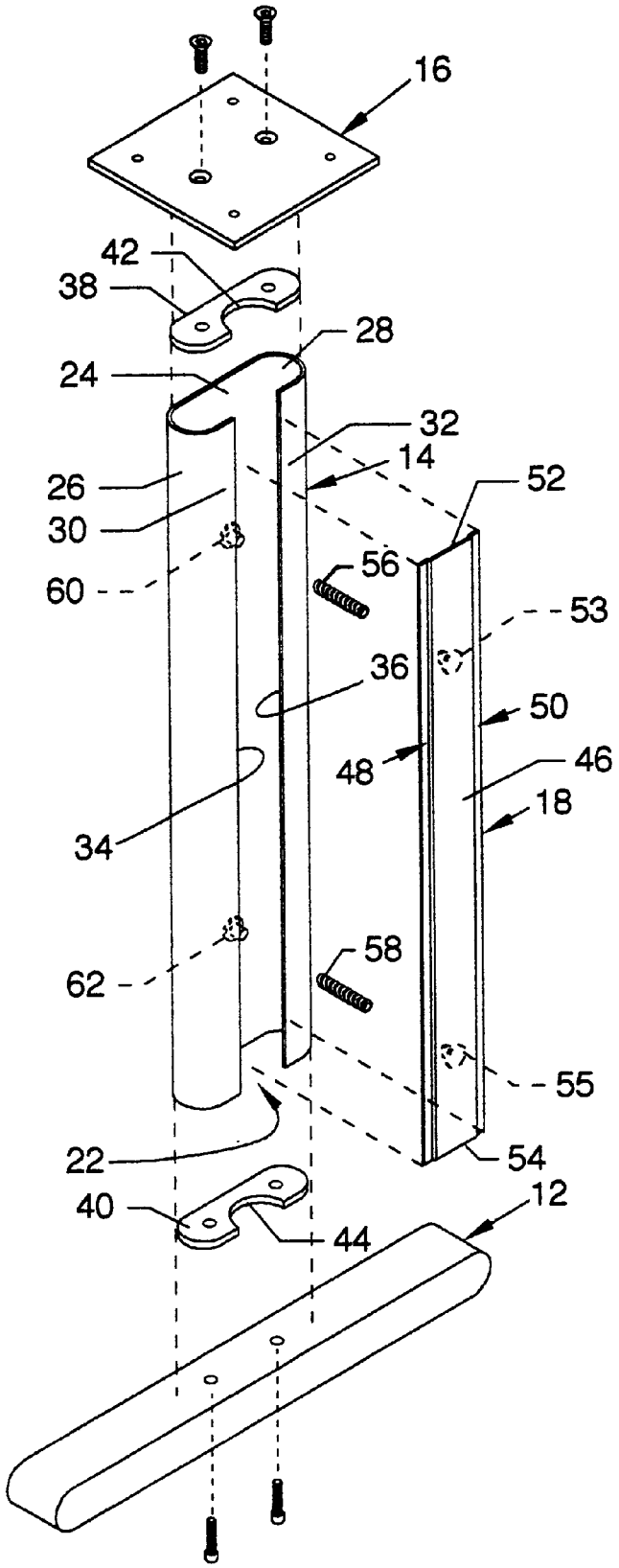
FIG. 2 illustrates an isometric exploded view of the table leg with a cable management system.

FIG. 2 illustrates an isometric exploded view of the table leg with a cable management system 10, where all numerals mentioned before correspond to those elements previously described. The open C-shaped channel 14, a continuous and elongated C-shaped channel, includes a planar back 24, opposing left and right curved ends 26 and 28 respectively extending from the planar back 24, opposing left and right planar panels 30 and 32 extending inwardly towards each other from the opposing left and right curved ends 26 and 28, and opposing edges 34 and 36 located at the inward extremities of the left and right planar panels 30 and 32. The channel opening 22, through which cables and the like are loaded, is located between and formed by the opposing vertically oriented edges 34 and 36. Upper and lower mounting gussets 38 and 40, respectively, include cutouts 42 and 44, respectively, and are shaped to conform with and to fit and align in and secure such as by welding to the inner periphery of the upper and lower regions of the open C-shaped channel 14. The positionable access panel 18 is vertically shorter than the open C-shaped channel 14 and the channel opening 22 to provide upper and lower access openings, as later described in detail. The positionable access panel 18 includes a planar panel portion 46 having configured left and right lips 48 and 50, respectively, the shape of which is described later in detail, extending substantially outwardly therefrom, and a top edge 52 opposing a bottom edge 54. The positionable access panel 18 aligns within the channel opening 22 and behind the left and right planar panels 30 and 32 of the open C-shaped channel 14, as later shown in detail. Upper and lower horizontally aligned mounting posts 53 and 55 secure to the inner face of the planar panel portion 46 to frictionally engage one end of upper and lower springs 56 and 58; and upper and lower horizontally aligned mounting posts 60 and 62 secure to the inner face of the planar back 24 to frictionally engage the remaining ends of the upper and lower springs 56 and 58, thereby springingly securing the positionable access panel 18 to the open C-shaped channel 14. Various fastening devices suitably secure the mounting plate 16 and the base 12 to the mounting gussets 38 and 40, respectively.

Figure 3:
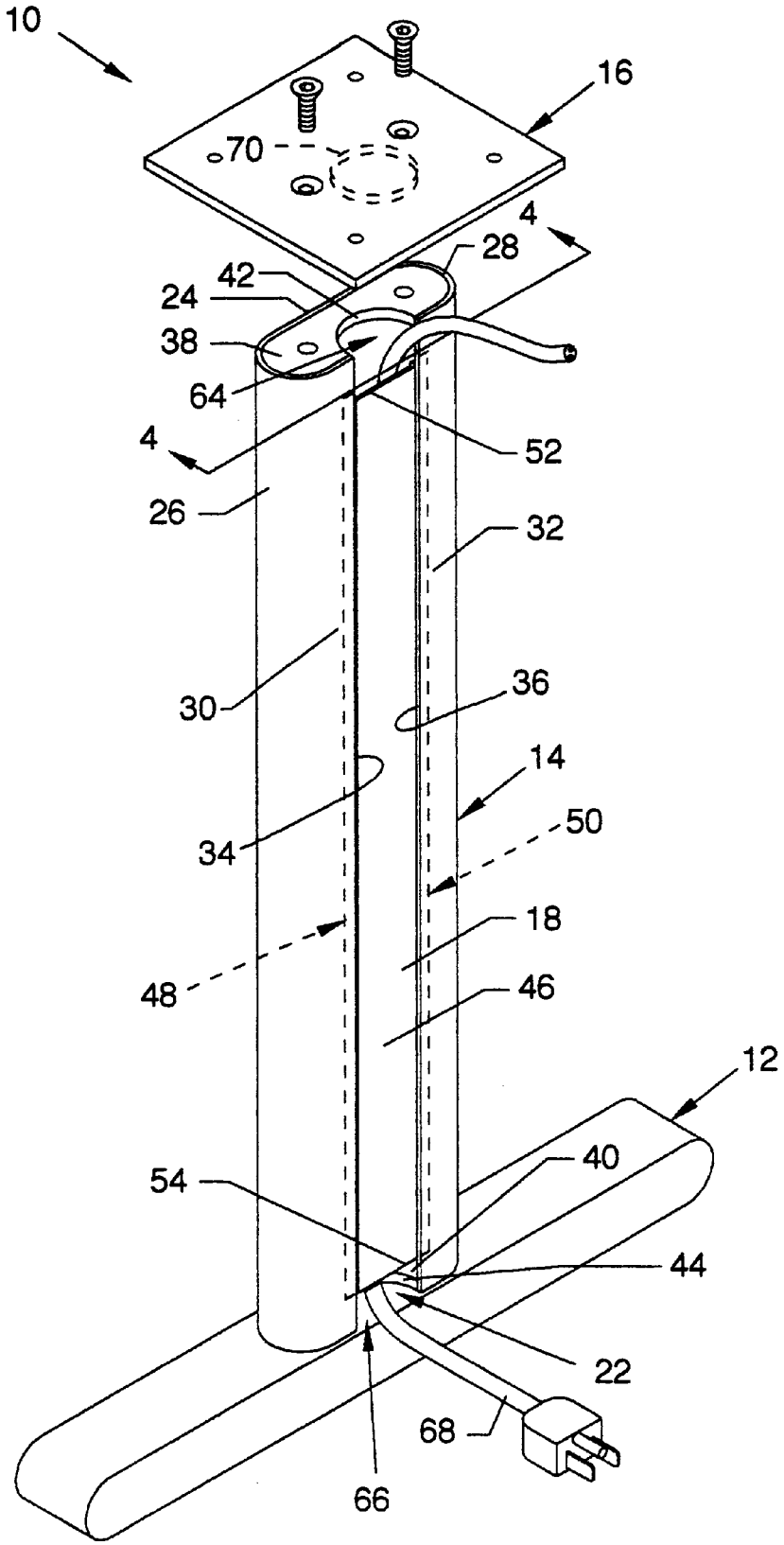
FIG. 3 illustrates an isometric partially exploded view of the table leg with a cable management system.

FIG. 3 illustrates an isometric partially exploded view of the table leg with a cable management system 10, where all numerals mentioned before correspond to those elements previously described. The mounting plate 16 is shown removed from the upper region of the open C-shaped channel 14 to reveal the structure at the upper portion of the open C-shaped channel 14 including an upper access opening 64 formed by the top edge 52 of the positionable access panel 18 and the upper regions of the opposing edges 34 and 36. An opposing lower access opening 66 is located at the bottom of the open C-shaped channel 14 which is formed by the bottom edge 54 of the positionable access panel 18 and the lower regions of the opposing edges 34 and 36. One or more electric cables 68, or other cords, cables, hoses, conduits or the like can be routed through the lower access opening 66, through the interior of the leg defined by the inner surfaces of open C-shaped channel 14 and aligned positionable access panel 18 to exit through the upper access opening 64 where the electric cable(s) can be routed to the appropriate device(s) on an attached table top (not shown) which is supported by the mounting plate 16. In the alternative, another access hole 70 in the mounting plate 16, shown in dashed lines, can be incorporated in alignment with the cutout 42 to route the electric cable 68 or other such items vertically through an attached table top if desired.

Figure 4:
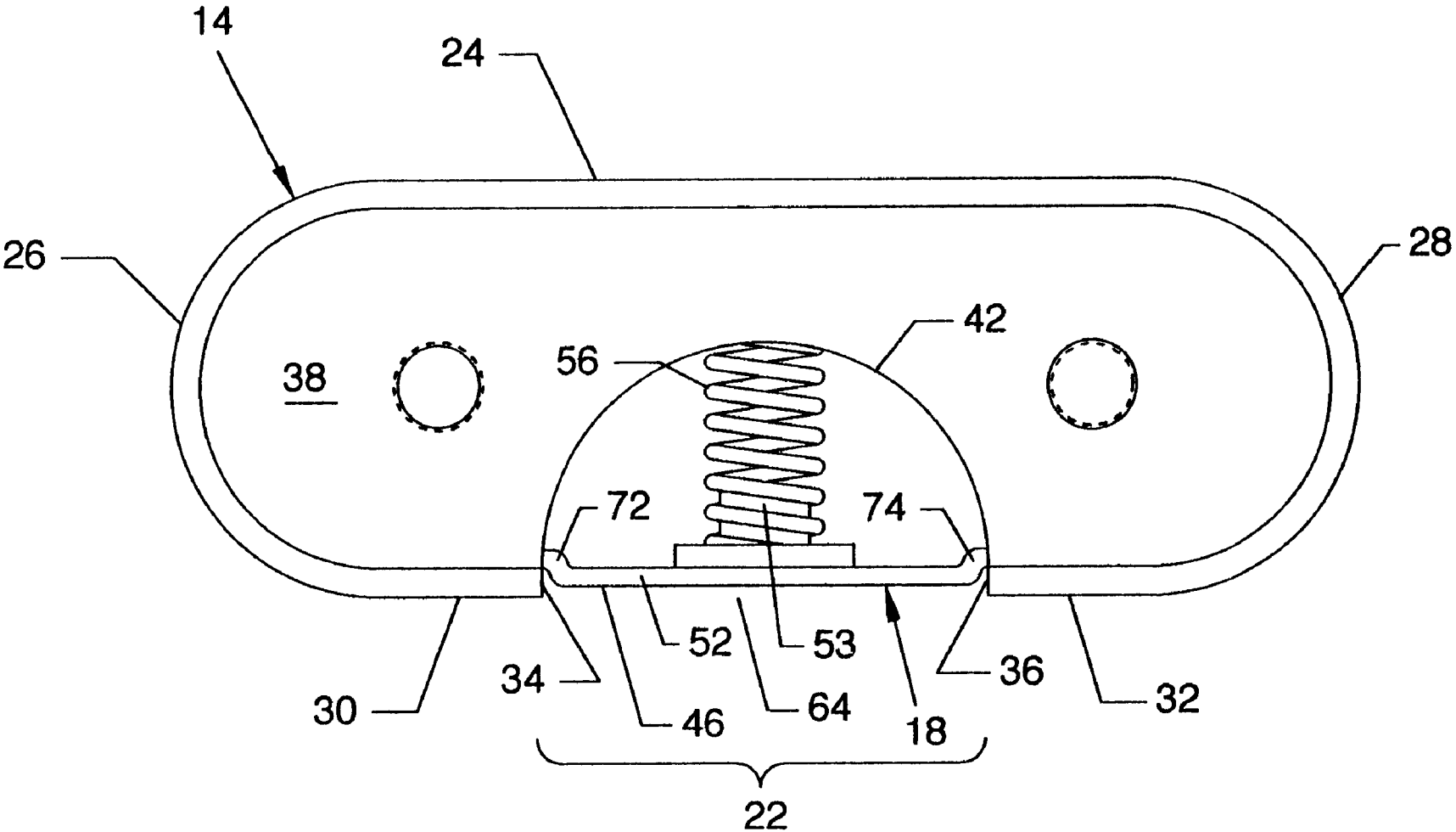
FIG. 4 illustrates a top view of the open C-shaped channel, the mounting gusset, spring and the positionable access panel.

FIG. 4 illustrates a top view of the open C-shaped channel 14, the mounting gusset 38, spring 56 and the positionable access panel 18, where all numerals mentioned before correspond to those elements previously described. Illustrated in particular is the positionable access panel 18 spanning and engaging the channel opening 22.

Figure 5:
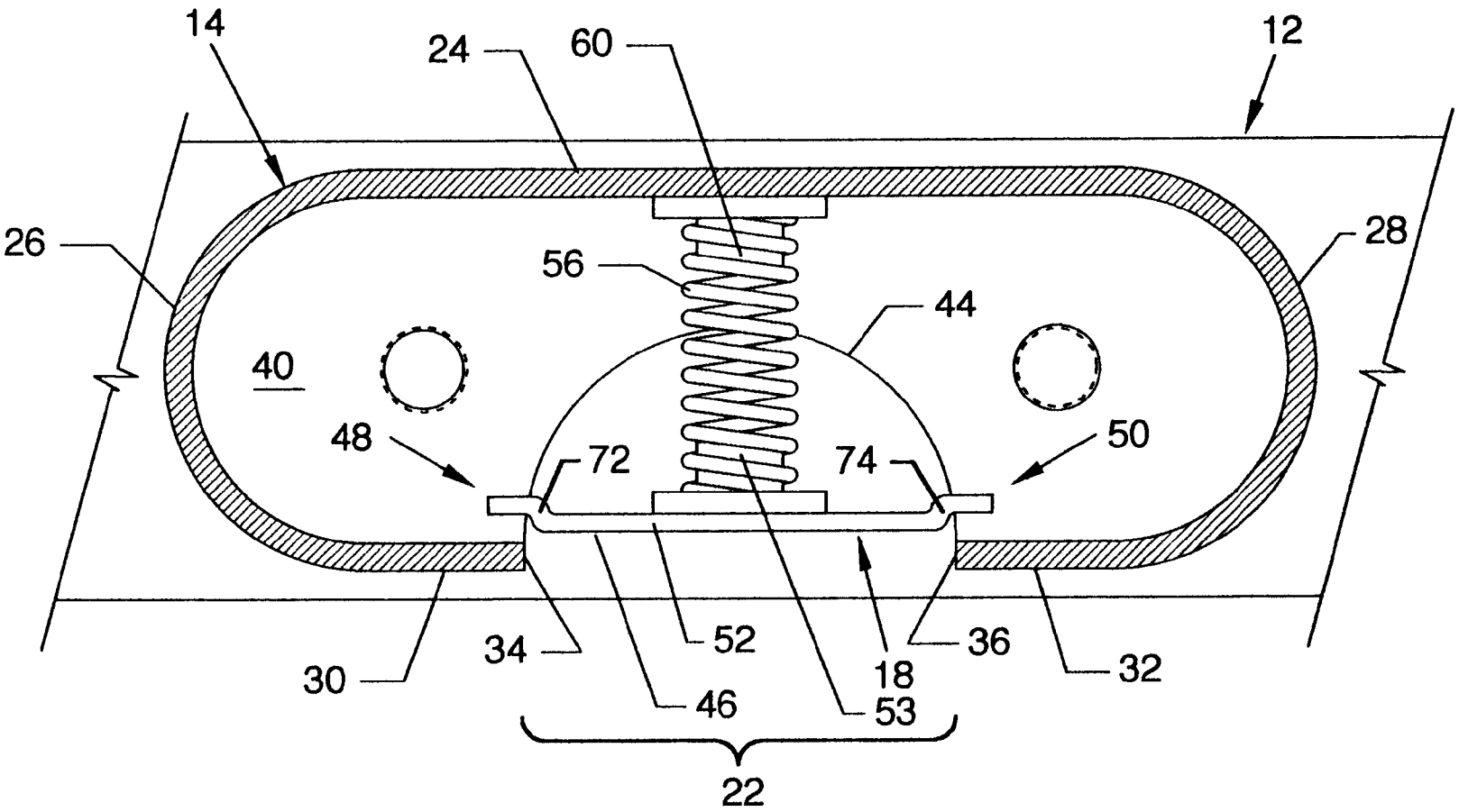
FIG. 5 illustrates a section view of the table leg with a cable management system along line 4—4 of FIG. 3.
Figure 7:
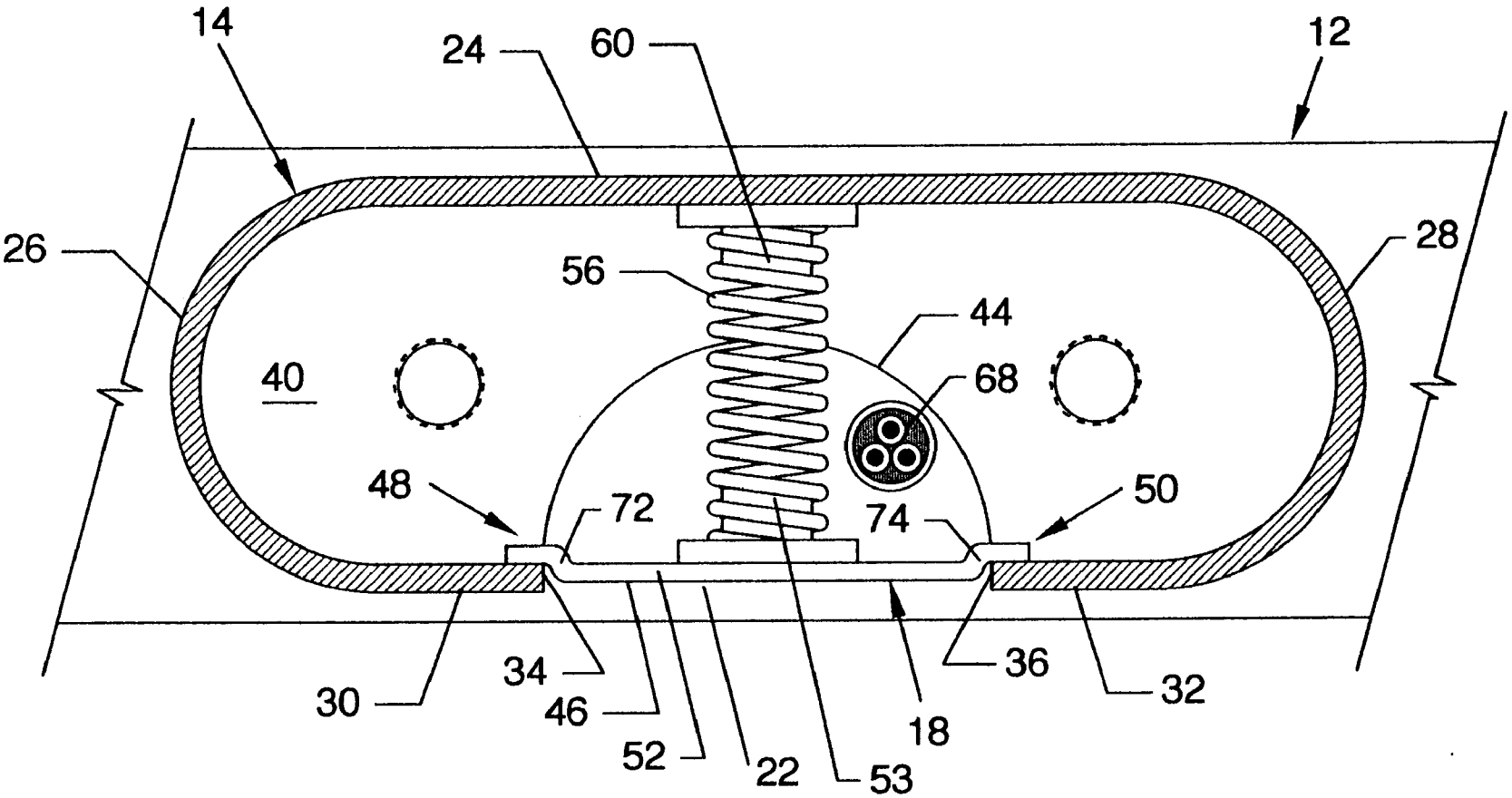

FIG. 5 illustrates a section view of the table leg with a cable management system 10 along line 4—4 of FIG. 3, where all numerals mentioned before correspond to those elements previously described. The positionable access panel 18 is shown positioned inwardly from the left planar panel 30 and the right planar panel 32 and inwardly from the channel opening 22 to best and most clearly illustrate the profile of the positionable access panel 18. Left and right lips 48 and 50 are offset from the plane of the planar panel portion 46 by left and right angled portions 72 and 74, respectively. The relationship of the left lip 48 and left angled portion 72 of the positionable access panel 18 together is such that the rear side of the left planar panel 30 and the adjoining edge 34 align thereto in mutual accommodation such as also illustrated in FIG. 7. In a like fashion, the relationship of the right lip 50 and right angled portion 74 of the positionable access panel 18 together is such that the rear side of the right planar panel 32 and the adjoining edge 36 align thereto in mutual accommodation. With reference to FIG. 7, the positionable access panel 18 is shown in full engagement generally across the channel opening 22 by the outwardly directed force and urging provided by the spring 56 (and 58) and, more specifically, the left lip 48 and left angled portion 72 of the positionable access panel 18 together engage the rear side of the left planar panel 30 and the adjoining edge 34 and the right lip 50 and right angled portion 74 of the positionable access panel 18 together engage the rear side of the right planar panel 32 and the adjoining edge 36. Once engaged, the positionable access panel 18 is prevented from lateral side to side motion across the channel opening 22 by the engagement of the left and right angled portions 72 and 74 of the positionable access panel 18 with the edges 34 and 36 of the open C-shaped channel 14.

Figure 6:
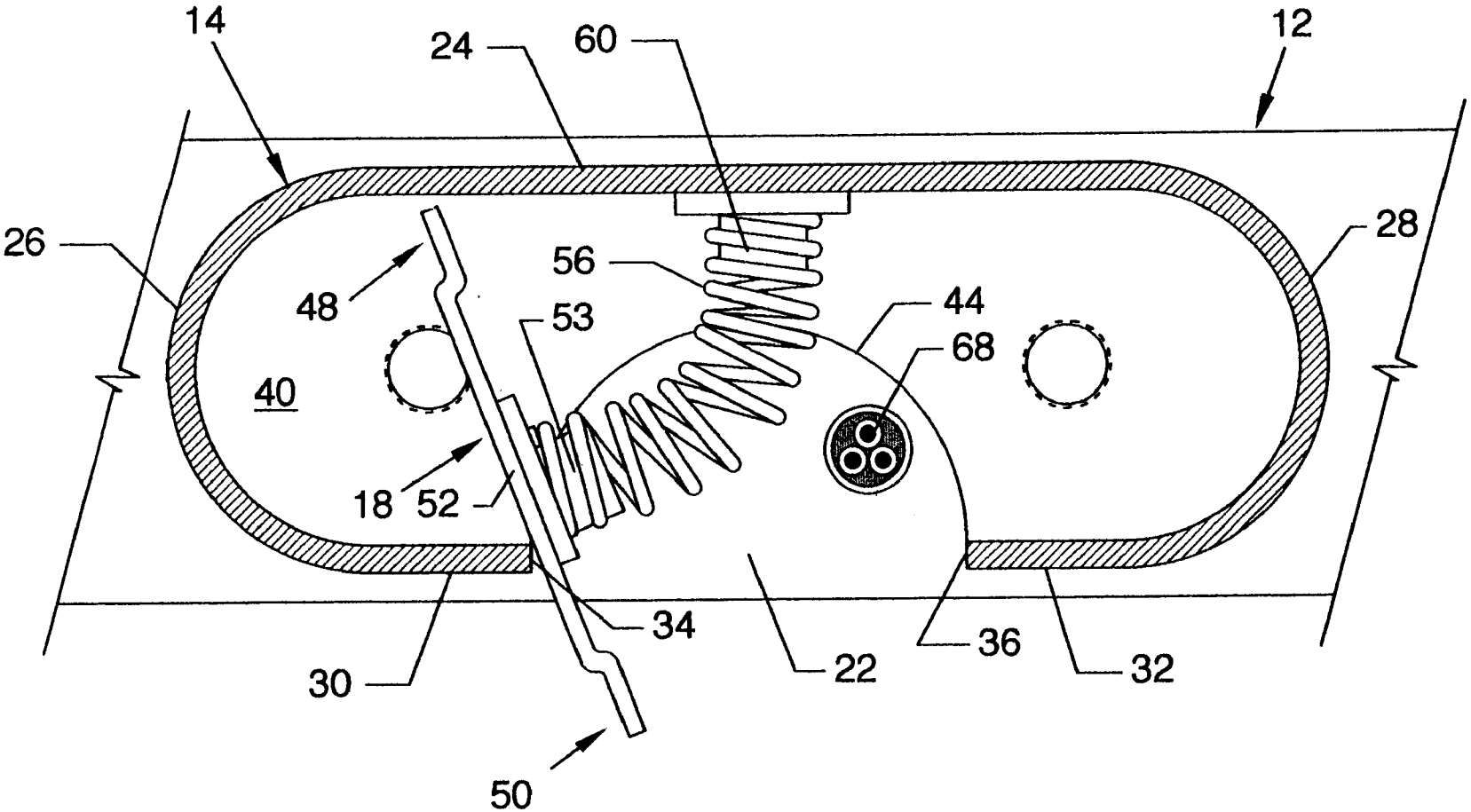
FIGS. 6 and 7 are sectional views similar to that view shown in FIG. 5 illustrating the mode of operation of the invention.

FIGS. 6 and 7, each being sectional views similar to that view shown in FIG. 5, illustrate the mode of operation of the invention, where all numerals mentioned before correspond to those elements previously described. Loading of one or more electric cables 68 into the interior of the open C-shaped channel 14 is readily accomplished by manually displacing the positionable access panel 18 from spring-held engagement with the channel opening 22 to provide access to the interior of the open C-shaped channel 14 as shown in FIG. 6, placing the electric cable(s) 68 through the channel opening 22 followed by manually returning the positionable access panel 18 to re-engage the channel opening 22, thereby containing the cable(s) 68 between the inner periphery of the open C-shaped channel 14 and the engaged positionable access panel 18. The electric cable 68 is located in a secure position behind the positionable access panel 18. Inadvertent sideways removal of the electric cable 68 is prevented by the access panel 18 which blocks the channel opening 22 which is held in position by the springs 56 and 58. Almost no amount of applied sideways force on the electric cable can force the positionable access panel 18 open, as it is constrained by the edges 34 and 36 of the open C-shaped channel structure 14. FIG. 6 illustrates maneuvering of the left lip 48 of the positionable access panel 18 inwardly to the interior of the open C-shaped channel 14 and maneuvering of the right lip 50 outwardly through the channel opening 22 to the exterior of the open C-shaped channel 14; however, the positionable access panel 18 could just as well be maneuvered where the right lip 50 is positioned inwardly to the interior of the open C-shaped channel 14 and the left lip 48 is outwardly positioned through the channel opening 22. Maneuvering of the positionable access panel 18 in either case bendingly occurs about the springs 56 and 58. Once the positionable access panel 18 is maneuvered into engagement with the channel opening 22, pressure from the springs 56 and 58 urges the positionable access panel 18 into firm engagement with the channel opening 22 where the appropriate components of the positionable access panel 18 engage the appropriate components of the open C-shaped channel 14, as previously described.

Figure 8:
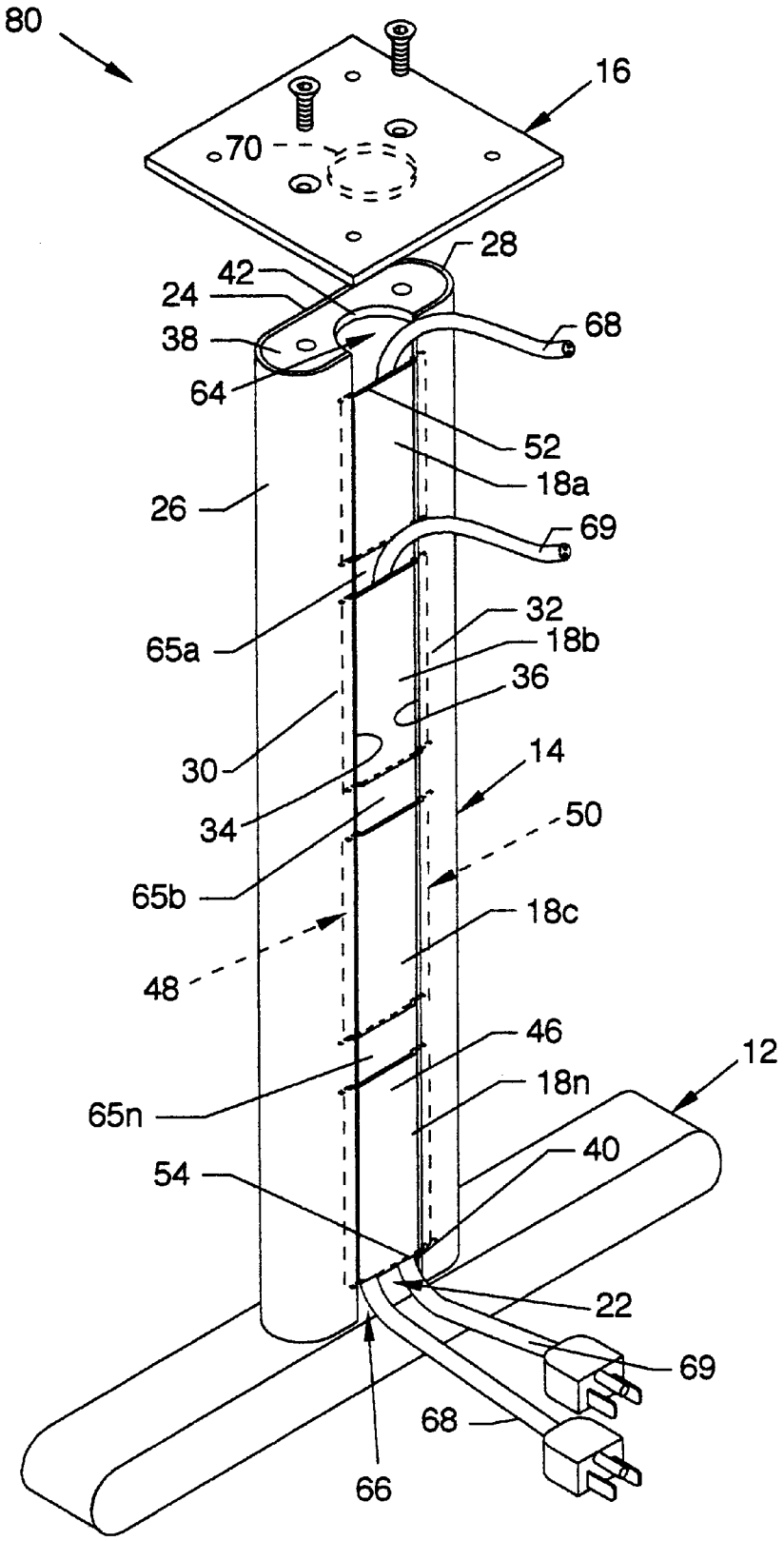
FIG. 8, a first alternate embodiment, illustrates an isometric view of the table leg with a cable management system having a plurality of positionable access panels and intermediate access openings therebetween and access thereto.

FIG. 8, a first alternate embodiment, illustrates an isometric view of the table leg with a cable management system 80, where all numerals mentioned before correspond to those elements previously described. The table leg with a cable management system 80 is constructed along the same principles and design of the table leg with a cable management system 10, but includes a plurality of positionable access panels 18*a*–18*n* in lieu of the single positionable access panel 18 and intermediate access openings 65*a*–65*n* located between the positionable access panels 18*a*–18*n*. The positionable access panels 18*a*–18*n* are of the same geometry and cross section as the single positionable access panel 18, but are of a shorter vertical dimension than the single positionable access panel 18 and constructed in the same manner and fashion as the single positionable access panel 18 including at least two springs, such as upper and lower springs 56 and 58, shown previously. Each of the positionable access panels 18*a*–18*n* can be of a different vertical dimension as desired, and the intermediate access openings 65*a*–65*n* can be of various vertical dimensions as required to accommodate various and sundry cable routing requirements. Multiple cables such as cables 68 and 69 can be routed into the lower access opening 66, or even an intermediate access opening 65*a*–65*n*, and can exit at another intermediate access opening 65*a*–65*n* or at the upper access opening 64. In the alternative, an appropriate length of the C-shaped open channel 14 and associated components can be used by itself to route electric cables, wires, tubing and the like along a wall adjacent to work spaces or work areas where the cables and other items can be inserted by manually operating one or more of the positionable access panels 18*a*–18*n* and where the cables align in any of the access openings.

Figure 9:
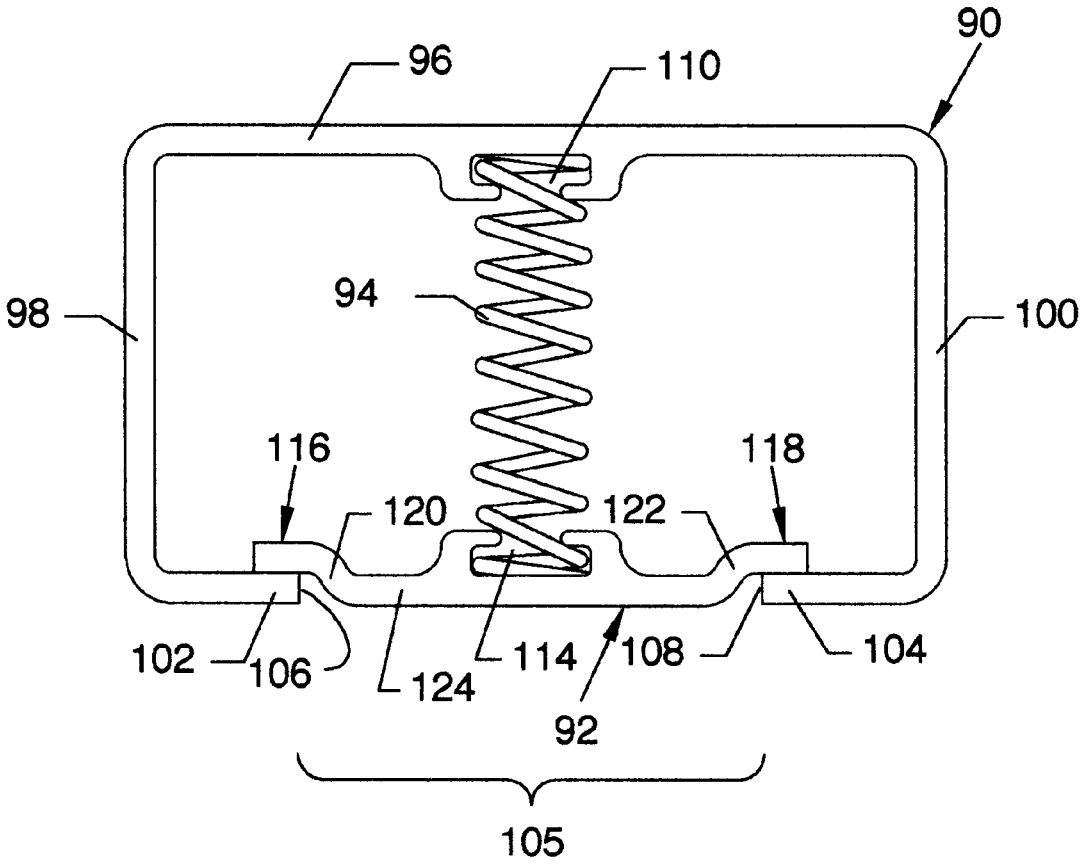
FIG. 9, a second alternate embodiment, illustrates a top view of an alternatively shaped square-shaped open channel structure including a positionable access panel; and, FIG. 10, a third alternate embodiment, illustrates a top view of an alternatively shaped triangular-shaped open channel structure including a positionable access panel.

FIG. 9, a second alternate embodiment, illustrates a top view of an alternatively shaped square-shaped open channel structure 90 including a positionable access panel 92 of shorter length. The operation of the device is accomplished according to the teachings of the invention; however, the structure is modified to provide for easier mounting of one or more springs 94. The square-shaped open channel structure 90 includes a substantially planar back 96, opposing planar sides 98 and 100, and left and right planar front panels 102 and 104 having left and right vertically aligned edges 106 and 108 which define a channel opening 105 which accommodates the positionable access panel 92 and through which cables are loaded. A vertically aligned channel 110 extends along and about the interior of the planar back 96 to slidingly accommodate in frictional engagement one end of a spring 94. The other end of the spring 94 is slidingly accommodated in frictional engagement by a similarly shaped and vertically aligned channel 114 extending vertically along and about the rear side of the positionable access panel 92. The positionable access panel 92 also includes left and right lips 116 and 118, respectively, and left and right angled portions 120 and 122 leading from the lips 116 and 118 to the planar panel portion 124 of the positionable access panel 92. The left and right lips 116 and 118, respectively, and left and right angled portions 120 and 122 leading from the lips 116 and 118 forcibly engage, by applied spring pressure, the left and right planar front panels 102 and 104 and left and right vertically aligned edges 106 and 108 in a manner as previously described in preceding embodiments.

Figure 10:
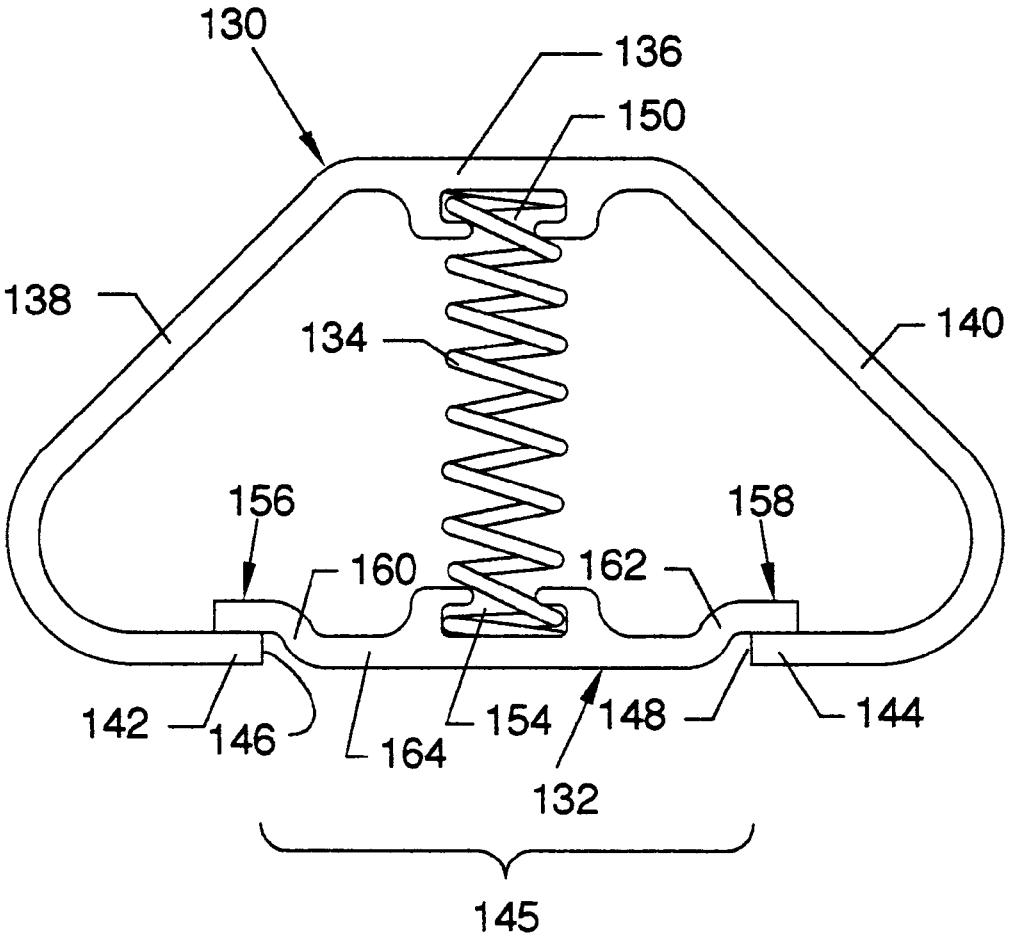

FIG. 10, a third alternate embodiment, illustrates a top view of an alternatively shaped triangular-shaped open channel structure 130 including a positionable access panel 132 of shorter length for mounting and use between intersecting planar structures such as found on a table or other structures such as walls intersecting other walls or a ceiling or floor. The operation of the device is accomplished according to the teachings of the invention; however, the structure is modified to provide for easier mounting of one or more springs 134. The triangular-shaped open channel structure 130 includes a substantially planar back 136, opposing planar and angled sides 138 and 140, and left and right planar front panels 142 and 144 having left and right vertically aligned edges 146 and 148 which define a channel opening 145 which accommodates the positionable access panel 132 and through which cables are loaded. A vertically aligned channel 150 extends along and about the interior of the planar back 136 to slidingly accommodate in frictional engagement one end of a spring 134. The other end of the spring 134 is slidingly accommodated in frictional engagement by a similarly shaped and vertically aligned channel 154 extending vertically along and about the rear side of the positionable access panel 132. The positionable access panel 132 also includes left and right lips 156 and 158, respectively, and left and right angled portions 160 and 162 leading from the lips 156 and 158 to the planar panel portion 164 of the positionable access panel 132. The left and right lips 156 and 158, respectively, and left and right angled portions 160 and 162 leading from the lips 156 and 158 forcibly engage, by applied spring pressure, the left and right planar front panels 142 and 144 and left and right vertically aligned edges 146 and 148 in a manner as previously described in preceding embodiments. It can be seen that various shaped open channel structures can be fashioned for use in conjunction with a positionable access panel and that the shape of the open channel structures shall not be limited to those shown and that various shaped open channel structures are within the scope of the invention.

Various modifications can be made to the present invention without departing from the apparent scope hereof.

| PARTS LIST | |
|---|---|
| 10 | table leg with cable management system |
| 12 | base |
| 14 | open C-shaped channel structure |
| 16 | mounting plate |
| 18 | positionable access panel |
| 18a–n | positionable access panels |
| 22 | channel opening |
| 24 | planar back |
| 26 | left curved end |
| 28 | right curved end |
| 30 | left planar panel |
| 32 | right planar panel |
| 34 | edge |
| 36 | edge |
| 38 | mounting gusset |
| 40 | mounting gusset |
| 42 | cutout |
| 44 | cutout |
| 46 | planar panel portion |
| 48 | left lip |
| 50 | right lip |
| 52 | top edge |
| 53 | mounting post |
| 54 | bottom edge |
| 55 | mounting post |
| 56 | upper spring |
| 58 | lower spring |
| 60 | mounting post |
| 62 | mounting post |
| 64 | upper access opening |
| 65a–n | intermediate access openings |
| 66 | lower access opening |
| 68 | cable |
| 69 | cable |
| 70 | access hole |
| 72 | left angled portion |
| 74 | right angled portion |
| 80 | table leg with cable management system |
| 90 | square-shaped open channel structure |
| 92 | positionable access panel |
| 94 | spring |
| 96 | planar back |
| 98 | planar side |
| 100 | planar side |
| 102 | left front planar panel |
| 104 | right front planar panel |
| 105 | channel opening |
| 106 | edge |
| 108 | edge |
| 110 | channel |
| 114 | channel |
| 116 | lip |
| 118 | lip |
| 120 | angled portion |
| 122 | angled portion |
| 124 | planar panel portion |
| 130 | triangular-shaped open channel structure |
| 132 | positionable access panel |
| 134 | spring |
| 136 | planar back |
| 138 | angled planar side |
| 140 | angled planar side |
| 142 | left front planar panel |
| 144 | right front planar panel |
| 145 | channel opening |
| 146 | edge |
| 148 | edge |
| 150 | channel |
| 154 | channel |
| 156 | lip |
| 158 | lip |
| 160 | angled portion |
| 162 | angled portion |
| 164 | planar panel portion |

What is claimed is:

1. A table leg with a cable management system for cables comprising:

a. a base;

b. an open C-shaped channel means secured to said base;

c. at least one mounting post secured to said C-shaped channel means, said C-shaped channel having inner edges;

d. a planar panel portion with opposing lips;

e. at least one mounting post secured to said planar panel portion; and, f. a spring between said mounting posts for engaging said lips of said planar portion against the inner edges of said open C-shaped channel means, thereby adapted to cover cables in the open C-shaped channel means.

2. A structural member with provision for cable or wire management and being for use as a table leg, comprising:

a. a rigid elongated channel element having an access opening extending along its entire length;

b. A rigid access panel located within said channel element and positioned to close said access opening;

c. said access panel being movable between a closed position wherein it closes said access opening and an open position which allows entry of a cable or wire into said channel element through said access opening; and d. means for biasing said access panel to said closed position.

3. A structural member as defined in claim 2, wherein said access panel has an outer face and an inner face, closed position comprises at least one spring extending between said inner face of said access panel and an inner surface portion of said channel element.

4. A structural member as defined in claim 3, wherein each said at least one spring is a coil spring.

5. A structural member as defined in claim 3, wherein said inner face of said access panel and said inner surface portion of said channel element each includes means for anchoring an end of each said at least one spring thereto.

6. A structural member as defined in claim 2, wherein said channel element includes opposite ends, and wherein a base for engaging a floor or other supporting surface is attached to one of said opposite ends and a mounting plate for fastening to the undersurface of a table top is attached to the other of said opposite ends.

* * * * *